United States Patent [19]

Ciolino

[11] Patent Number: 4,973,049

[45] Date of Patent: Nov. 27, 1990

[54] AQUATIC EXERCISER

[76] Inventor: Peter A. Ciolino, 561 Cherry Tree La., Kinnelon, N.J. 07405

[21] Appl. No.: 335,280

[22] Filed: Apr. 10, 1989

[51] Int. Cl.[5] ..... A63B 21/00; A63B 31/08

[52] U.S. Cl. ..... 272/116; 272/71; 441/59; 441/61

[58] Field of Search ..... 272/71, 116; 441/58, 441/56, 55, 61-64

[56] References Cited

U.S. PATENT DOCUMENTS

| | | | |
|---|---|---|---|
| 397,059 | 1/1889 | Johnston | 441/61 |
| 516,963 | 3/1894 | Bunsen | 441/59 |
| 3,328,812 | 7/1967 | Berthiot | 441/58 |
| 4,416,451 | 11/1983 | Solloway | 272/116 |
| 4,509,744 | 4/1985 | Beasley | 272/71 X |
| 4,521,011 | 6/1985 | Solloway | 272/116 |
| 4,565,369 | 1/1986 | Bedgood | 272/116 X |
| 4,623,142 | 11/1986 | MacKechnie | 272/116 |
| 4,632,387 | 12/1986 | Guzman | 272/116 |

*Primary Examiner*—Richard J. Apley
*Assistant Examiner*—D. F. Crosby
*Attorney, Agent, or Firm*—Hopgood, Calimafde, Kalil, Blaustein & Judlowe

[57] ABSTRACT

A multi-fin aquatic exerciser comprises a main or caudal fin that is strapped to the dorsum of the user's hand or foot. A plurality of secondary fins are attached to the caudal fin and have a spatial configuration that provides significant flow resistance independent of the direction of the user's stroke. The multi-fin exerciser is used in conjunction with specific aquatic exercises providing a complete workout which is especially useful for athletic training, swimming, physical therapy, and shaping, toning, strengthening or enlarging specific muscle groups.

12 Claims, 2 Drawing Sheets

AQUATIC EXERCISER

The present invention generally relates to an apparatus for enhanced aquatic exercising. More particularly, the present invention relates to a multi-fin exerciser attachable to either the hand or foot for increasing motion resistance during aquatic movement.

BACKGROUND OF THE INVENTION

During the past decade, there has been an explosion of interest in physical activity as both a pastime and a means of acquiring and maintaining good health. Much of the current interest in exercise and other similar activities is based on the recent findings that correlate longevity with active lifestyles. Pursuant to this increased awareness, a corresponding increase in the variety of exercise activities has spawned a plethora of new businesses focused on servicing the needs of this new market.

Unfortunately, many of the most popular new activities engendered more physical damage than they prevented. For example, jogging on hard concrete is now cited as a significant cause for knee damage and other physical ailments related to joints and limbs. In response, many have sought exercise activities without the corresponding potential of injury.

It has long been recognized that swimming combines a rigorous workout with little associated stress on the limbs and joints, as the normal swim routine encounters few shocks. In fact, many health care professionals have recommended swimming to patients as both a form of exercise and therapy for repairing damaged joints. Such therapy can range from a mild workout for a stiff back, to specific limited movements at restricted water depths for seriously injured patients. In the latter situation, conventional swimming strokes are normally out of the question in view of the patient's condition. In such instances, the patient performs certain movements to concentrate the workout on a specific muscle group, such as the arms.

To increase the level of the workout in an aquatic environment, past devices have been designed to increase flow resistance during the desired motion. For example U.S. Pat. No. 4,509,744 discloses a aquatic exerciser for exercising the arms in water. In essence, the device is a paddle with a hand grip. A similar device is disclosed in U.S. Pat. No. 4,632,387 which shows a paddle structure with adjustable windows for regulating the flow of water therethrough when in use. As can be recognized, the flat paddle type aquatic exerciser is strictly limited to a narrow range of exercise motions, solely involving the hand and arms. A foot paddle device is disclosed in U.S. Pat. No. 4,565,369 that provides a plurality of adjustable panels for the exercise of the legs but, again restricted to a narrow range of movement directions. A barbell type device is disclosed in U.S. Pat. No. 4,623,142 which again is used to increase flow resistance while "lifting weights" in an aquatic environment.

Although the prior art devices provide for different types of aquatic exercise beyond mere swimming, they all suffer from specific drawbacks that act to limit their usefulness. More particularly, the prior devices are restricted in both form of exercise and degree of motion. This inhibits the exercise routines available in the aquatic environment to a specific subset, precluding a variety of movements. The user's efforts are focused on a select few muscles with associated fatigue and boredom acting to limit the effectiveness of the exercise.

It was with this understanding of the problems of the prior art devices that the present invention was developed.

SUMMARY AND OBJECTS OF THE INVENTION

An object of the present invention is to provide a device to enhance aquatic exercise routines performed in a swimming pool or similar environment.

Another object of the present invention is to provide an aquatic exercising device comprised of multiple fins having a specific spatial relationship so that flow resistance is significant independent of the direction of the user's stroke.

Yet another object of the present invention is to provide a multi-fin exerciser that can be attached to either the hand or foot and otherwise provides freedom of motion of the hand and fingers.

A further object of the present invention is to provide a detachable multi-fin device having fins spatially arranged so that significant flow resistance occurs in an aquatic environment independent of the direction of the stroke wherein said device can be used to stabilize the user's position during submersed operations.

The above and other objects of the present invention are realized in a specific illustrative multi-fin exerciser comprising a main fin with a curved frontal portion, a dorsal fin that runs down the center of the main fin and extends therefrom and is essentially perpendicular thereto, and multiple paired fins that also extend upwards from the main fin and lie perpendicular to the dorsal fin. Three separate straps are spaced along the perimeter of the main fin each having mating velcro fasteners to permit attachment to either the dorsum of the hand or the foot.

The foregoing features of the present invention may be more fully appreciated from the following detailed discussion of a specific illustrative embodiment thereof, presented hereinbelow in conjunction with the accompanying drawings, in which:

FIG. 1 provides a top view of the multi-fin exerciser of the present invention, and FIG. 2 provides a side view of the multi-fin exerciser shown in FIG. 1, and FIG. 3 provides a front view of the multi-fin exerciser shown in FIGS. 1 and 2.

DETAILED DESCRIPTION OF THE INVENTION

Discussing the present invention first in overview, it is a fundamental objective to provide a fin design that permits a variety of exercise routines to be performed in a aquatic environment with a single device. Therefore, the spatial arrangement of the fins on the exerciser must be such that flow resistance is significant in each direction of the user's stroke.

Figure 2:
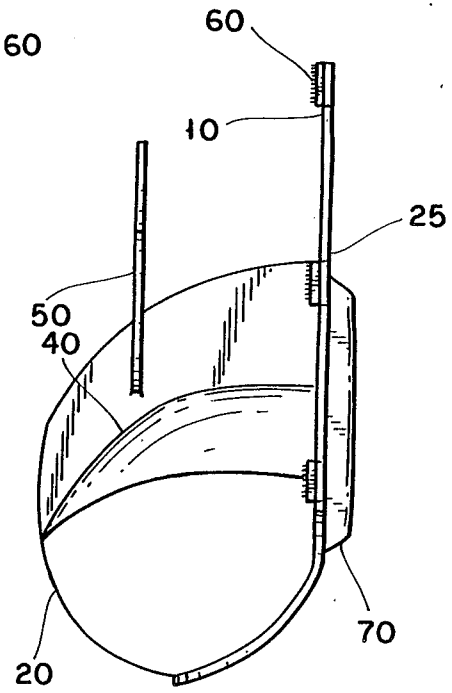
Figure 1:
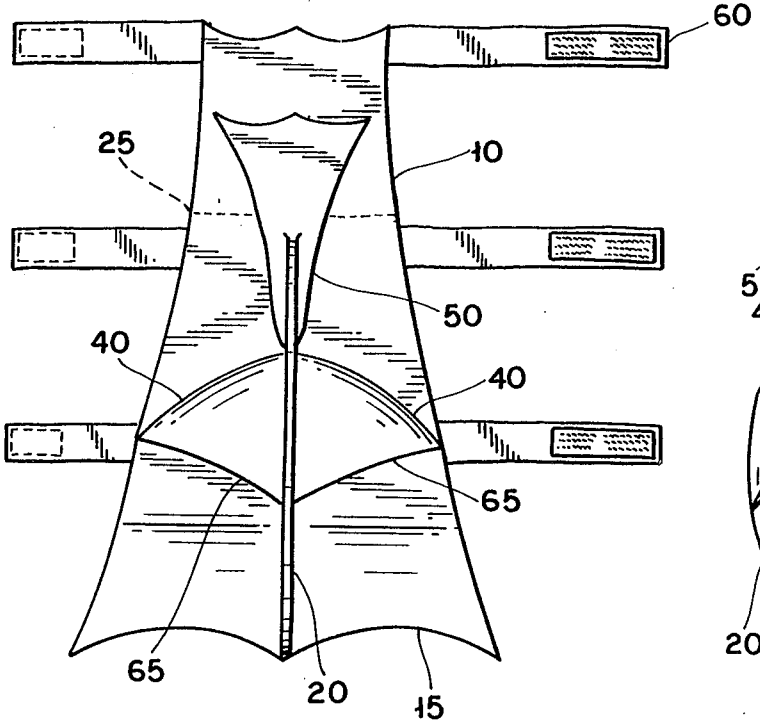

Bearing this in mind, and referring to FIG. 1, it is seen that the multi-fin exerciser comprises a main, or caudal fin 10, having a general configuration that closely resembles a conventional scuba fin as formed from a semi-rigid or stiffly flexible water resistant material. Caudal fin 10 ranges from six to fourteen inches long and three to six inches in width with a slight taper from the front end. As can be seen in FIG. 1, Caudal fin 10 has a slightly curved frontal portion 15. This curve corresponds to the dorsi flexion of the toes during aquatic jogging. The shape of caudal fin is held, in part, by dorsal fin 20 which runs almost the full length of caudal fin 10 and extending outwards from caudal fin 10 at substantially ninety degrees from the plane defined by caudal fin 10. Caudal fin 10 includes a point of flex 25, that corresponds to the location of the user's wrist when the exerciser is strapped in place.

Referring back to FIG. 1 dorsal fin 20 is shown dividing caudal fin 10 in essentially two equal sections. Secondary fins or "paired" fins 40 bridge the caudal fin 10 to the dorsal fin 20 at a location near the front portion of the fin assembly. These paired fins 40 also extend upward from the caudal fin and run perpendicularly to the dorsal fin with a slightly cupped upper region. The two paired fins 40 form recesses 65 on each side of dorsal fin 20. Due to the slight cant of the paired fins 40, the forward flow resistance is not symmetrical to the rearward drag force during a user's stroke although the difference in flow resistance is not substantial. The spatial arrangement of the fins is such that different fins or portions thereof will act to create different levels of flow resistance contingent of the direction of the stroke. Tail fin 50 can be seen extending outward from dorsal fin 20 in a plane substantially parallel to caudal fin 10.

Figure 3:
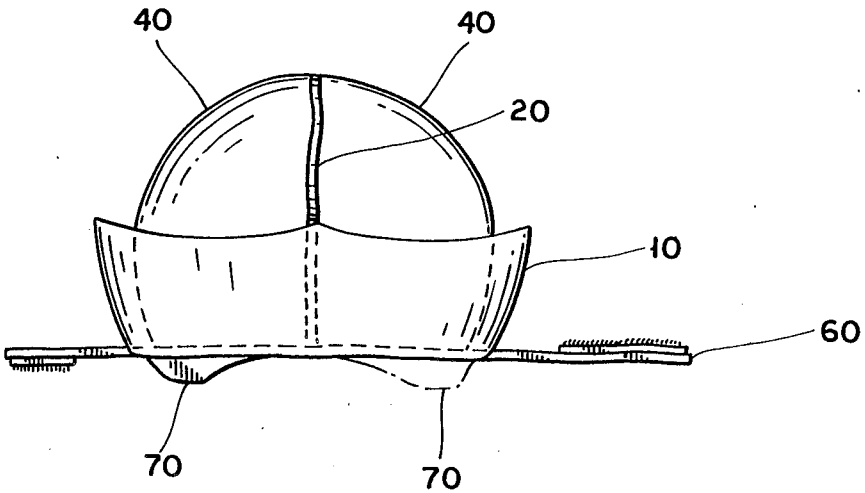

Attachment of the multi-fin exerciser to the hand or foot is done via velcro straps 60, which loop around the wrist or sole of the foot respectively. A form fitting contour 70 is provided to enhance the adhesion of the exerciser to the hand or foot during use. FIG. 3 shows a right handed multi-fin exerciser with the contour 70 in bold. The broken line contour 70 indicates the shape for a left handed multi-fin exerciser. From this, it can be seen that there, is a left and right handed exerciser, depending on the location of contour 70. In addition, as seen in FIG. 1, the point of flex 25 is provided to permit the multi-fin exerciser to flex corresponding to the movement of the user's wrist.

As stated above, the materials of construction are water resistant having a semi-rigid flexing characteristic. The caudal fin 10 should have a rigidity somewhat above the dorsal fin 20, tail fin 50 and paired fins 40. The stiffness of the caudal fin should be such that it substantially retains its shape when subjected to flow resistance during aquatic movements. A suitable material is a natural or synthetic rubber with a medium durometer. Other materials can be freely substituted as determined by the mode of manufacture and cost considerations, as will be recognized by those skilled in this art. The multi-fin exerciser is made by conventional injection molding techniques. Alternative manufacturing methods include assembly of the separately sectioned fins, as attached together by known means such as ultra-sonic welding or adhesives.

The use of the multi-fin exerciser is specific to the aquatic environment. The exerciser is strapped onto the dorsum of the hand prior to a submerged exercise routine. The user then performs a series of strokes in the water wherein the direction of hand motion is selectively altered. The change in stroke directions assures the user that different muscle groups receive the beneficial exercise. After the routine is ended for the hand, the exerciser is strapped to the dorsum of the foot and a second routine focusing on foot strokes is performed. Alternatively, the multiple fin exercisers can be placed on both hands and/or both feet for a more complete and simultaneous exercising routine. By this means, the user can do a complete exercise routine in the water which will provide therapeutic exercise to diverse muscle groups with a single tool. Such a routine can include running in place, boxing, jumping jacks or certain forms of specific athletic training routines, (i.e., bicycling, golf, tennis, etc.) in addition to the more conventional water strokes.

A second use of the multi-fin exerciser is directed to those instances when work is to be done in a submersed environment. In many cases such work requires the hands to be free to operate tools. Also, the worker desires to maintain his balance while performing his task. It has been found that the multi-fin exerciser as attached to the hand permits the user to quickly correct his balance in the water by simply moving his arms against the imbalancing force, while his hands remain free to continue work on the submersed task.

The above-described arrangement is merely illustrative of the principles of the present invention. Numerous modifications and adaptations thereof will be readily apparent to those skilled in this art without departing from the spirit and scope of the present invention.

I claim:

1. In combination in a device for enhanced muscle development by resistive aquatic exercise comprising a fin constructed and configured to fit on the dorsum portion of a user's hand and foot, wherein said fin includes a main fin having an elongated planer shape with a length greater than its width, a curved frontal portion corresponding to the dorsi flexion of the toes during aquatic jogging and made of stiffly flexible material that will substantially retain its shape when subjected to a level of force corresponding to the user's foot movement in an aquatic environment, said fin includes a plurality of secondary fins arranged and configured so that movement of said fin in said aquatic environment is met with a significant level of flow resistance in all directions of movement of the fin in the aquatic environment, said fin further includes a point of flex located substantially perpendicular to the length of said main fin and corresponding to the point of flexure of the user's wrist, said fin further includes a means of attachment to the dorsum portion of the user's hand without substantially interfering with the user's ability to otherwise grasp objects while wearing said fin.

2. In combination in the device of claim 1 wherein said plural secondary fins are located on a top side of said main fin and include a dorsal fin and two paired fins wherein said dorsal fin extends substantially perpendicular to said main fin and substantially parallel to the direction of the length of the main fin and said paired fins extend substantially perpendicular to said main fin and said dorsal fin.

3. In combination in the device of claim 2 wherein said plural secondary fins are more flexible than the main fin.

4. In combination in the device of claim 2 further comprising a back fin attached to said dorsal fin and extending out therefrom in a direction substantially parallel to said main fin.

5. In combination in the device of claim 1 wherein said fin is further configured to be capable of attachment to the palm of the hand.

6. In combination in the device of claim 1 wherein said fin is further configured so that the fin is subjected to different levels of flow resistance in at least three substantial directions of movement in the aquatic environment.

7. In combination in a device to be attached to a user's hand so that the user can maintain balance while operating in an aquatic environment comprising a fin constructed and configured to fit on the dorsum portion of the user's hand, wherein said fin includes a main fin having an elongated planer shape with a frontal portion curved, a length greater than its width and made of stiffly flexible material that will substantially retain its shape when subjected to a level of force corresponding to the user's foot movement in an aquatic environment, said fin includes a plurality of secondary fins arranged and configured so that movement of said fin in said aquatic environment is met with a significant level of flow resistance in all directions of movement of the fin in the aquatic environment, said fin further includes a point of flex located substantially perpendicular to the length of said main fin and corresponding to the point of flexure of the user's wrist, said fin further includes a means of attachment to the dorsum portion of the user's hand without substantially interfering with the user's ability to otherwise grasp objects while wearing said fin.

8. In combination in the device of claim 7 wherein said plural secondary fins are located on a top side of said main fin and include a dorsal fin and two paired fins wherein said dorsal fin extends substantially perpendicular to said main fin and substantially parallel to the direction of the length of the main fin and said paired fins extend substantially perpendicular to said main fin and said dorsal fin.

9. In combination in the device of claim 8 wherein said plural secondary fins are more flexible than the main fin.

10. In combination in the device of claim 8 further comprising a back fin attached to said dorsal fin and extending out therefrom in a direction substantially parallel to said main fin.

11. In combination in the device of claim 7 wherein said fin is further configured to be capable of attachment to the palm of the hand.

12. In combination in the device of claim 7 wherein said fin is further configured so that the fin is subjected to different levels of flow resistance in at least three directions of movement in the aquatic environment.

* * * * *